US008836464B2

(12) United States Patent
Wang

(10) Patent No.: US 8,836,464 B2
(45) Date of Patent: Sep. 16, 2014

(54) EXPLOSION-PROOF AND FLAMEPROOF EJECTION TYPE SAFETY SURGE-ABSORBING MODULE

(75) Inventor: Robert Wang, Taoyuan County (TW)

(73) Assignee: Ceramate Technical Co., Ltd., New Taipei (TW)

( * ) Notice: Subject to any disclaimer, the term of this patent is extended or adjusted under 35 U.S.C. 154(b) by 187 days.

(21) Appl. No.: 13/346,948

(22) Filed: Jan. 10, 2012

(65) Prior Publication Data

US 2012/0105191 A1 May 3, 2012

Related U.S. Application Data

(63) Continuation-in-part of application No. 12/490,683, filed on Jun. 24, 2009, now abandoned.

(51) Int. Cl.

| | |
|---|---|
| ***H01H 37/76*** | (2006.01) |
| ***H01C 7/12*** | (2006.01) |
| ***H01T 1/14*** | (2006.01) |

(52) U.S. Cl.

CPC ..... *H01C 7/126* (2013.01); *H01H 37/76* (2013.01); *H01H 37/761* (2013.01); *H01H 2037/763* (2013.01); *H01T 1/14* (2013.01)

USPC ..... 337/6; 337/5; 337/401; 337/405; 337/406; 338/21; 338/22 R

(58) Field of Classification Search

CPC . H01H 37/76; H01H 2037/763; H01H 69/00; H01H 37/761; H01C 7/126; H01T 1/14

USPC ..... 29/619; 337/5, 6, 401, 405, 406; 338/21, 22 R

See application file for complete search history.

(56) References Cited

U.S. PATENT DOCUMENTS

| | | | | | |
|---|---|---|---|---|---|
| 3,903,494 | A | * | 9/1975 | May | 338/20 |
| 4,107,759 | A | * | 8/1978 | Shirn et al. | 361/275.4 |
| 4,107,762 | A | * | 8/1978 | Shirn et al. | 361/534 |
| 4,212,045 | A | * | 7/1980 | Martzloff | 361/127 |
| 4,288,833 | A | * | 9/1981 | Howell | 361/124 |
| 4,538,347 | A | * | 9/1985 | Palilla et al. | 29/619 |
| 4,975,674 | A | * | 12/1990 | Sumiyoshi et al. | 338/21 |
| 5,315,474 | A | * | 5/1994 | Kuriyama | 361/534 |
| 5,363,272 | A | * | 11/1994 | Tanaka et al. | 361/534 |
| 5,708,553 | A | * | 1/1998 | Hung | 361/103 |
| 5,781,394 | A | * | 7/1998 | Lorenz et al. | 361/124 |
| 5,901,027 | A | * | 5/1999 | Ziegler et al. | 361/124 |

(Continued)

*Primary Examiner* — Anatoly Vortman

(74) *Attorney, Agent, or Firm* — Chun-Ming Shih; HDLS IPR Services

(57) ABSTRACT

An explosion-proof and flameproof ejection type safety surge-absorbing module includes a protective member and a surge-absorbing unit. The protective member includes a base and an upper lid coupled with the base. The base has two corresponding partitions extending upwards. The surge-absorbing unit includes a body, two connecting leads, and a resilient metallic plate. The body has two sides defining two electrode surfaces. One of the electrode surfaces is connected with one of the connecting leads. The resilient metallic plate has a first end welded to the electrode surface with a contact component and a second end curved and striding across an outer side of one of the partitions to penetrate through the bottom of the base. When the body of the surge-absorbing unit is overheated due to high temperature caused by a surge, the contact component will melt so the resilient metallic plate is ejected away from the electrode.

5 Claims, 8 Drawing Sheets

(56) References Cited

U.S. PATENT DOCUMENTS

| | | | | |
|---|---|---|---|---|
| 5,982,597 | A * | 11/1999 | Webb | 361/103 |
| 6,094,128 | A * | 7/2000 | Bennett et al. | 338/21 |
| 6,204,746 | B1 * | 3/2001 | Kane et al. | 337/32 |
| 6,211,770 | B1 * | 4/2001 | Coyle | 338/21 |
| 6,252,488 | B1 * | 6/2001 | Ziegler et al. | 337/5 |
| 6,307,462 | B2 * | 10/2001 | McLoughlin | 338/21 |
| 6,430,019 | B1 * | 8/2002 | Martenson et al. | 361/124 |
| 6,636,403 | B2 * | 10/2003 | McLoughlin et al. | 361/103 |
| 7,375,943 | B2 * | 5/2008 | Lu | 361/126 |
| 7,453,681 | B2 * | 11/2008 | Ho | 361/127 |
| 7,477,503 | B2 * | 1/2009 | Aszmus | 361/124 |
| 7,483,252 | B2 * | 1/2009 | de Palma et al. | 361/127 |
| 7,728,709 | B2 * | 6/2010 | Grunbichler et al. | 337/4 |
| 7,741,946 | B2 * | 6/2010 | Ho | 337/5 |
| 2008/0129440 | A1 * | 6/2008 | Ho | 337/5 |

* cited by examiner

EXPLOSION-PROOF AND FLAMEPROOF EJECTION TYPE SAFETY SURGE-ABSORBING MODULE

This applications is a continuation-in-part of, and claims a priority to U.S. Ser. No. 12/490,683 filed on Jun. 24, 2009 now abandoned.

BACKGROUND OF THE INVENTION

1. Field of the Invention

This invention relates to an explosion-proof and flameproof ejection type safety surge-absorbing module.

2. Description of the Prior Art

Generally, in order to prevent a surge (a pulse voltage or a pulse current) suddenly occurred in daily life from damaging electrical equipment, a surge absorber is normally provided in a circuit of an electrical appliance. In a conventional circuit, a thermal fuse is further added so that the surge absorber will cause an open circuit for protecting the equipment or surge absorber itself when a surge or a high temperature is detected.

Although the thermal fuse is capable of causing an open circuit in the circuit with a surge absorber, however, it may not take place in a short period of time the surge absorber to be overheated. Thus, the surge absorber could cause explosion or start a fire to damage the equipment. Thus, an improved surge absorber is needed.

SUMMARY OF THE INVENTION

The main object of the present invention is to provide an explosion-proof and flameproof ejection type safety surge-absorbing module which can cause an open circuit without being overheated.

Another object of the present invention is to provide an explosion-proof and flameproof ejection type safety surge-absorbing module which can cause an open circuit without generating flame or causing explosion.

The main feature of the present invention is to provide a resilient metallic plate to be normally welded to the electrode through a contact component which shall be melted when the electrode is overheated. The resilient metallic plate will be ejected away from the electrode when the contact component is melted.

Accordingly, the explosion-proof and flameproof ejection type safety surge-absorbing module according to the present invention comprises a protective member which comprises a base and an upper lid coupled thereto. The base has two partitions formed thereon and extended upwardly to form a chamber for the installation of a surge-absorbing unit. The surge-absorbing module further comprises a surge absorbing unit which comprises a body with two opposite sides forming two corresponding electrodes, and at least two connecting leads, each of which is connected to one of the electrodes. A resilient metallic plate having a first end welded to the electrode through a contact component, and a second end passing through the base of the protective member to form a third lead.

The leads of the surge-absorbing unit are connected respectively to power source and circuit load to form a normal circuitry to supply power to electric equipment. In case the body of the surge-absorbing unit is overheated due to high temperature caused by a surge, the contact component will be melted allowing the resilient metallic plate to be ejected away from the electrode. Therefore, the electric circuit will open without damaging the surge-absorbing module. In case the body explodes due to a very high temperature caused by the surge, the protective member will act to prevent any further accident.

BRIEF DESCRIPTION OF THE DRAWINGS

The object, advantages and features of the explosion-proof and flameproof ejection type safety surge-absorbing module of the present invention can be more apparent from the below detailed description of the preferred embodiments with reference to the accompanying drawings, wherein.

DETAILED DESCRIPTION OF THE PREFERRED EMBODIMENTS

Figure 1:
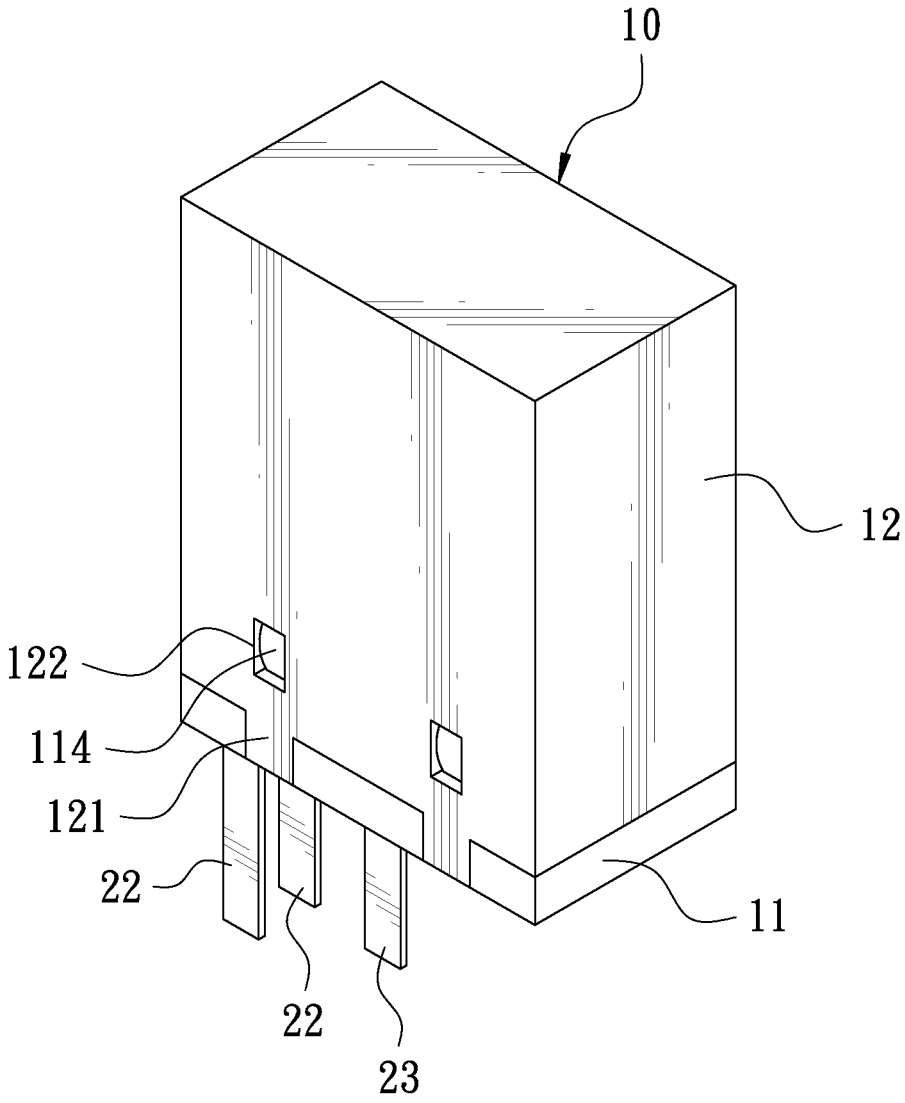
FIG. 1 is a perspective view of an explosion-proof and flameproof ejection type safety surge-absorbing module according to the present invention.
Figure 2:
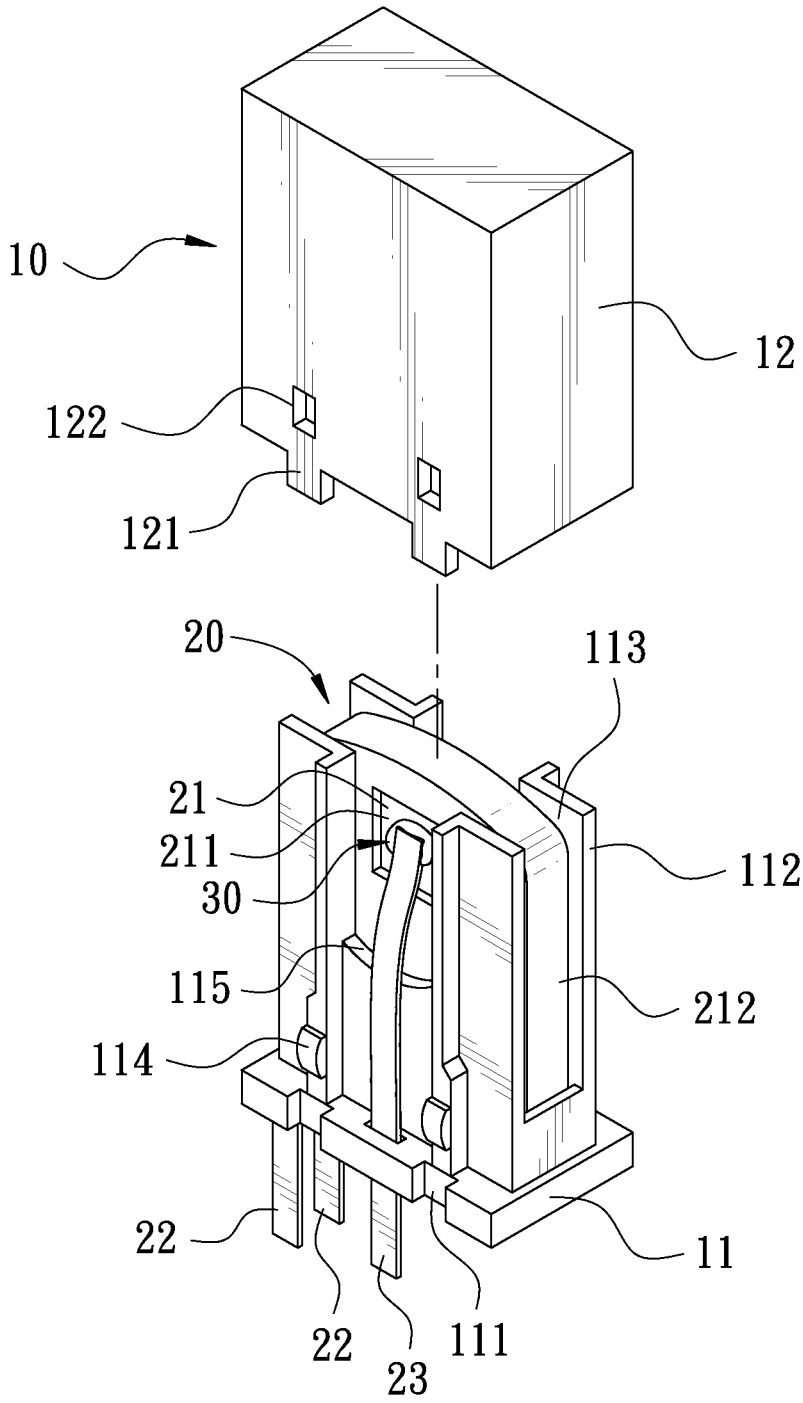
FIG. 2 is a perspective exploded view of an explosion-proof and flameproof ejection type safety surge-absorbing module according to the present invention.

Referring to FIG. 1 with reference to FIG. 2, which are a perspective and exploded view of the explosion-proof and flameproof ejection type safety surge-absorbing module according to the present invention, the surge absorbing module comprises a protective member 10 and a surge-absorbing unit 20.

The protective member 10 comprises a base 11 and an upper lid 12 coupled to said base 11. The base 11 has a plurality of notches 111 formed at a circumferential portion thereof and spaced apart from each other. Two partitions 112 are formed on the base 11 and extend upwardly to form a chamber 113 surrounded by the partitions 112. A plurality of protrusions 114 are formed on the wall of said partitions 112 and a recess 115 is provided at the middle portion of each partition 112.

The upper lid 12 has a plurality of tenons 121 fitting with the notches 111 of the base 11 so that the upper lid 12 can be coupled to the base 11. The upper lid 12 also has positioning holes 122 formed thereon to match with said protrusions 114 on the partitions 112 to form a tight connection between base 11 and the upper lid 12.

The surge-absorbing unit 20 comprises a body 21, two conducting leads 22 and a resilient metallic plate 23. The body 21 is made of Zinc Oxide and is accommodated in the chamber 113. The body 21 has two opposite sides forming two electrodes 211, respectively, and the two electrodes 211 are connected by said leads 22. The leads 22 and the resilient metallic plate 23 are extending out of the bottom of the base 11 of the protective member 10. The body 21 is wrapped with epoxy resin 212 which serves as an insulation between the electrodes 211. The upper portions of the conducting leads 22 are also wrapped in the epoxy resin 212. A first end of the resilient metallic plate 23 is welded to the electrode 211 through a contact component 30. This component 30 can be a solder or the like but with not a high melting point. The contact component 30 preferably is inserted in said recess 115 of said partitions 112. The resilient metallic plate 23 is naturally bent due to its resilience with its another end extending along the outside of the partitions 112, while abutting with its inner side an edge of said partition 112, and further penetrating through the bottom of the base 11.

Figure 3:
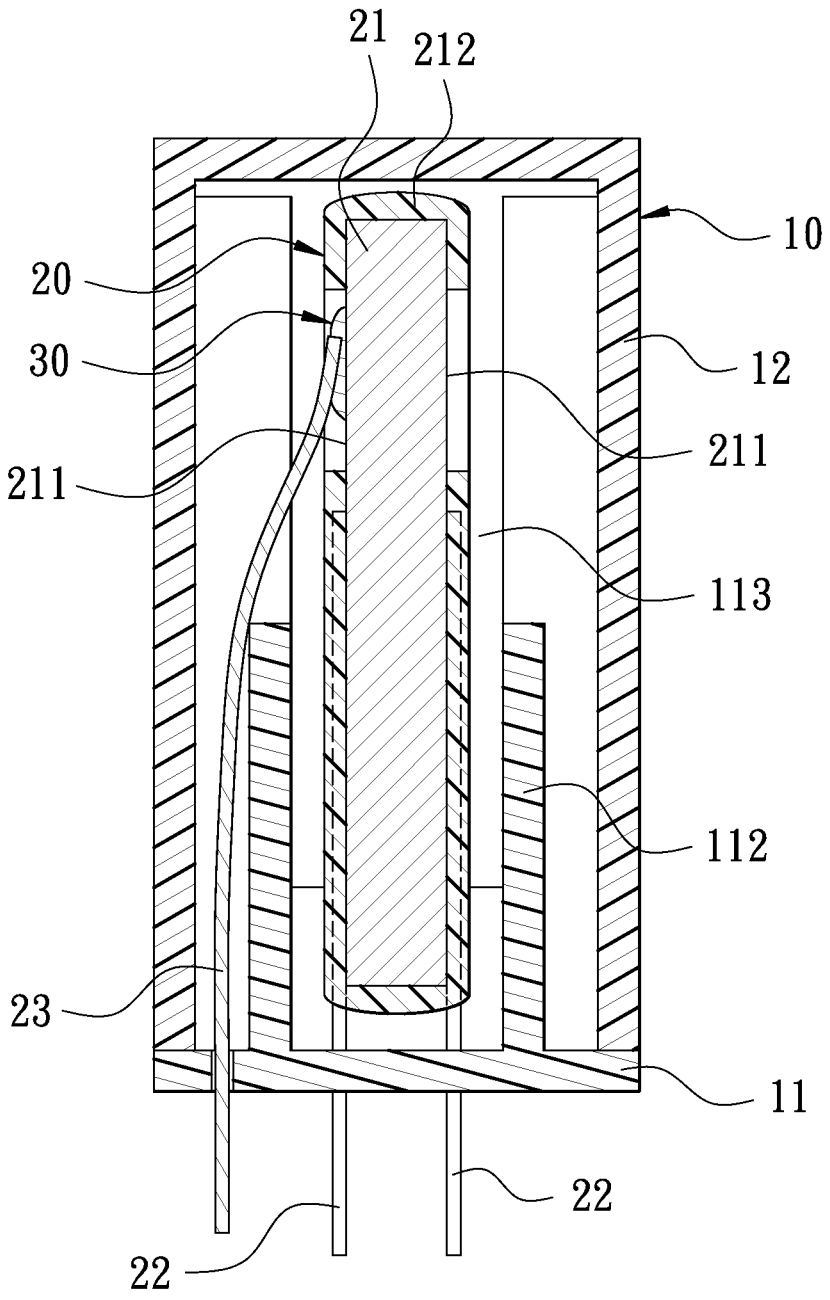
FIG. 3 is a cross-sectional view of an explosion-proof and flameproof ejection type safety surge-absorbing module according to the present invention.

Refer to FIG. 3, which shows a cross-sectional view of an explosion-proof and flameproof ejection type safety surge-absorbing module according to the present invention. One end of the resilient metallic plate 23 of the assembled surge-absorbing module is welded on one of the electrodes 211 through the contact component 30.

Figure 4:
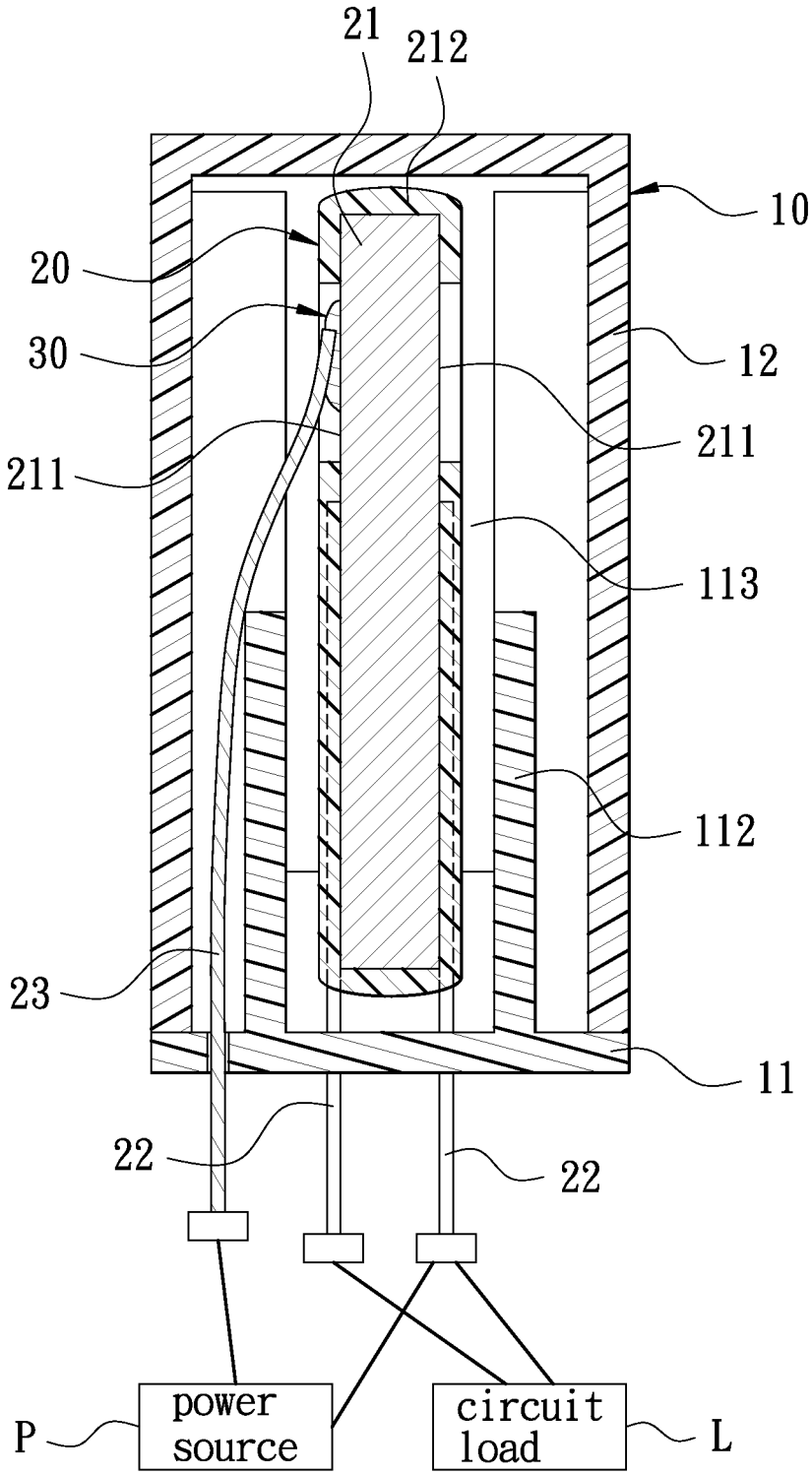
FIG. 4 is a cross-sectional view of an explosion-proof and flameproof ejection type safety surge-absorbing module illustrating the connection of the resilient metallic plate with power source and circuit load.
Figure 5:
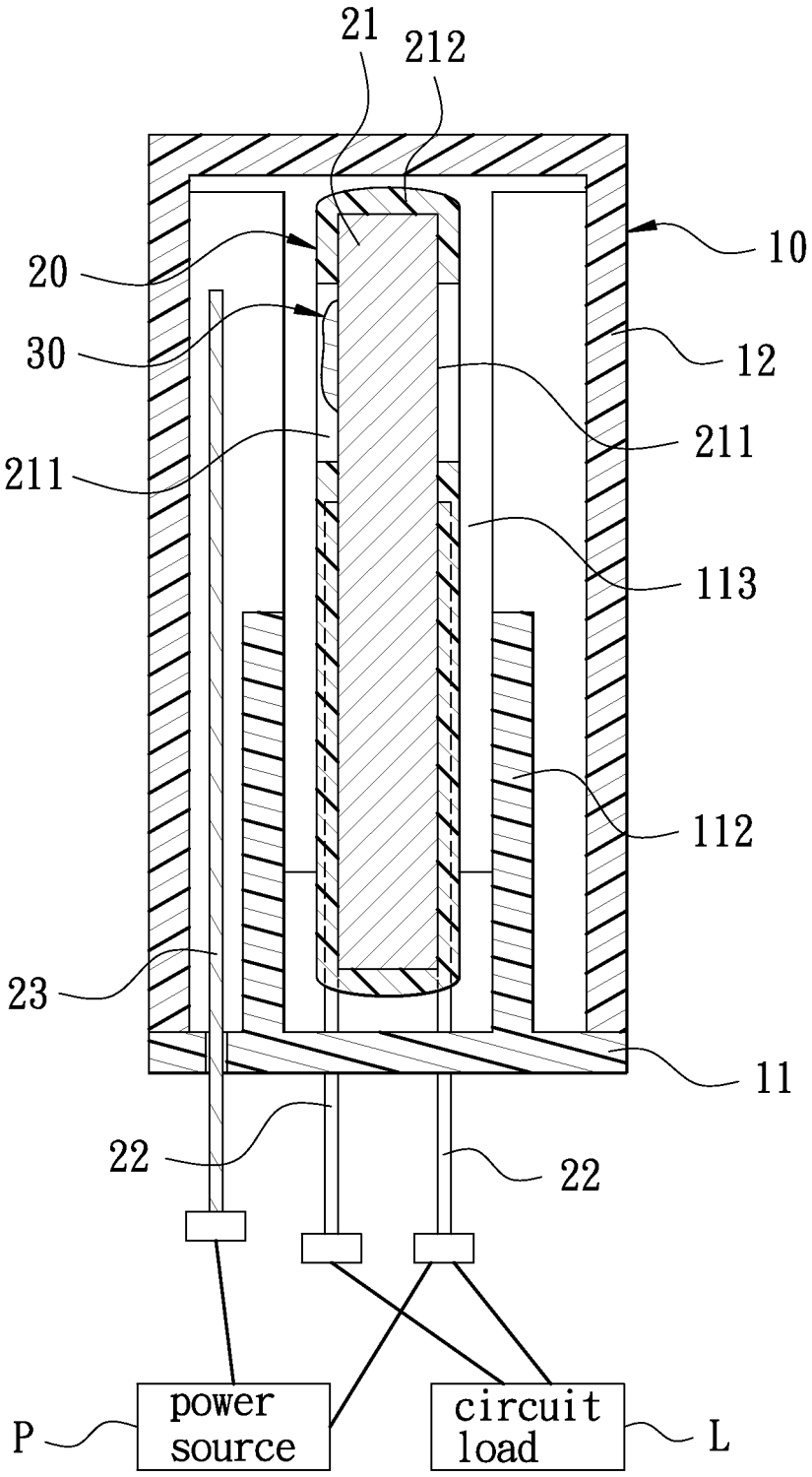
FIG. 5 is a cross-sectional view of an explosion-proof and flameproof ejection type safety surge-absorbing module illustrating the resilient metallic plate being ejected away from the electrode.

Refer to both FIGS. 4 and 5, which are cross-sectional views of the surge-absorbing module with illustration of circuit connection to Power Source P and Circuit Load L. When thunder lighting strikes the explosion-proof and flameproof ejection type safety surge-absorbing module according to the present invention, a surge is generated at Power Supply P. The surge will be conducted through the resilient metallic plate 23 to be absorbed by the surge-absorbing unit 20. In the meantime, the electrodes 211 will be heated by the electric energy brought by the surge. Once the electrode 211 is over-heated, the contact component 30 will be melted and the resilient metallic plate 23 will be ejected away from the electrode 211 and in turn forming an open circuit. In FIG. 5, the resilient metallic plate 23 has been ejected to an open-circuit position. This will prevent the circuit load L from damage It is to be noted that the contact component 30 shall be made of material with relatively low melting point so that the resilient metallic plate 23 can be disconnected from the electrodes 211 in a short time period. Also, one can easily understand, because one of the partitions 112 is situated between the body 21 and the resilient metallic plate 23, an electric arc caused by the surge can be prevented. Further, if the resilient metallic plate 23 is not ejected to form open circuit quickly enough and body 21 of the surge-absorbing unit 20 explodes, the upper lid 12 of the protective member 10 entirely covers the body 21 and still is able to prevent any further accident.

Figure 6:
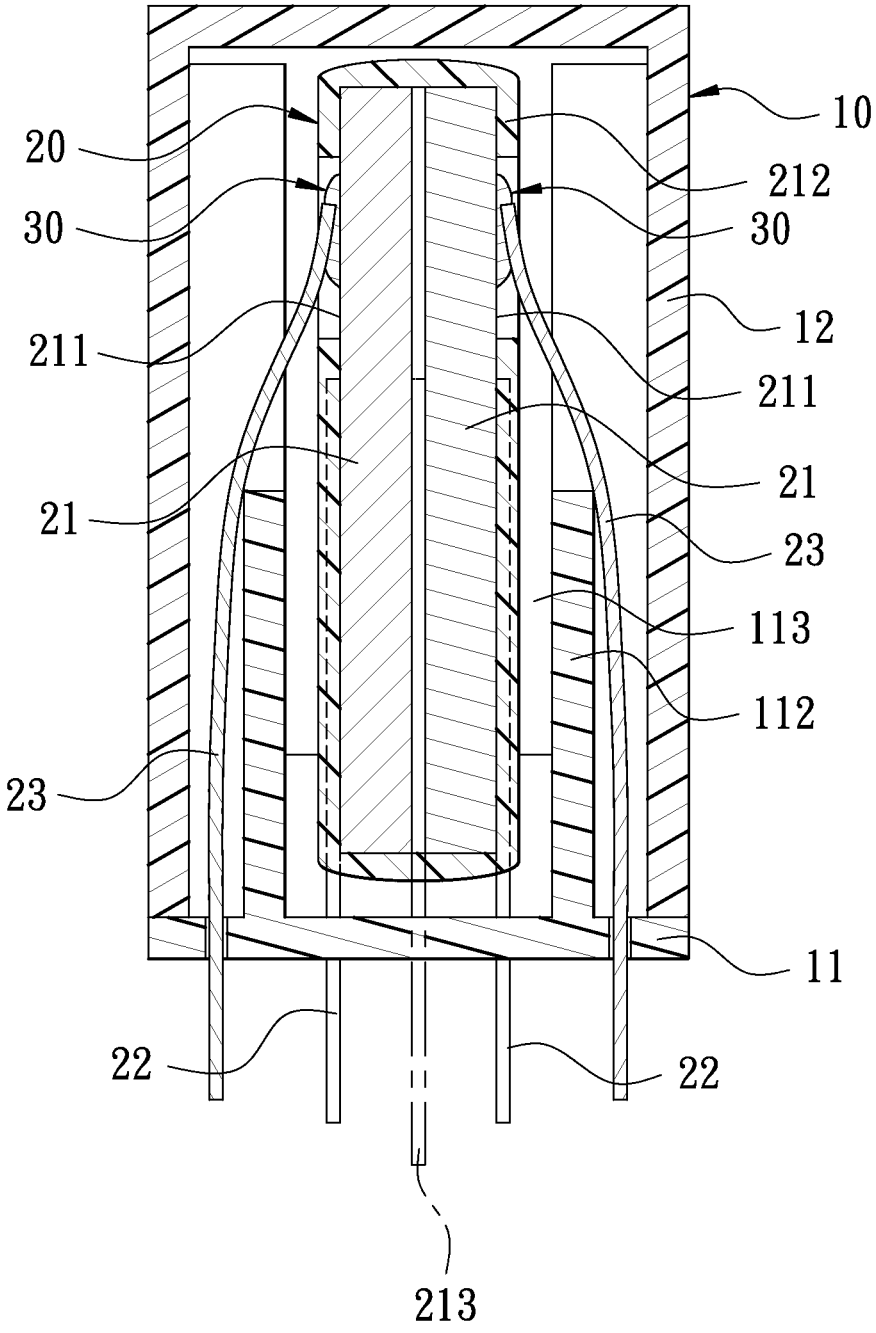
FIG. 6 is a cross-sectional view of a second embodiment of the explosion-proof and flameproof ejection type safety surge-absorbing module having two resilient metallic plates according to the present invention.

Refer to FIG. 6, which is a cross-sectional view of a second embodiment of the explosion-proof and flameproof ejection type safety surge-absorbing module having two resilient metallic plates according to the present invention. This module is substantially the same in structure as the first embodiment except the surge-absorbing unit 20 consisting of two bodies 21 and two resilient metallic plates 23. There are two electric leads 22 similar to structure of the first embodiment of the module shown in FIGS. 1 to 3. Referring to FIG. 6, the two bodies 21 are stacked and form a common lead 213 between the said two bodies 21. The two perspective sides of the bodies 21 form electrodes 211 respectively and the electric leads 22 are connected thereto. Each of the resilient metallic plates 23 has its one end connected to the respective electrodes 211 through contact component 30. And the other end of each of the resilient metallic plates 23 penetrates outwardly through the base 11 of the protective member 10.

Figure 7:
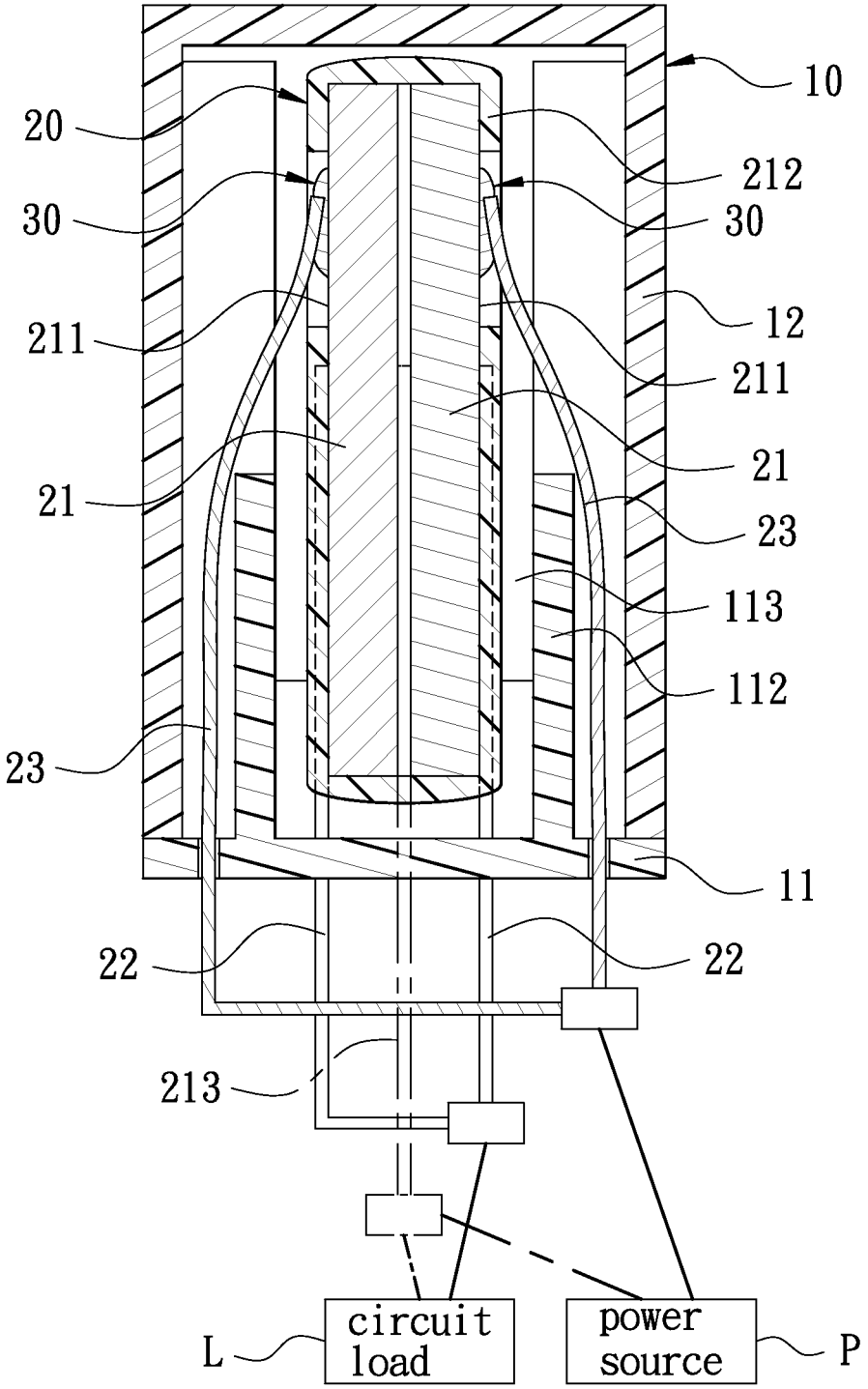
FIG. 7 is a cross-sectional view of the second embodiment of the explosion-proof and flameproof ejection type safety surge-absorbing module illustrating the resilient metallic plates connection to the electrodes, power source and circuit load.
Figure 8:
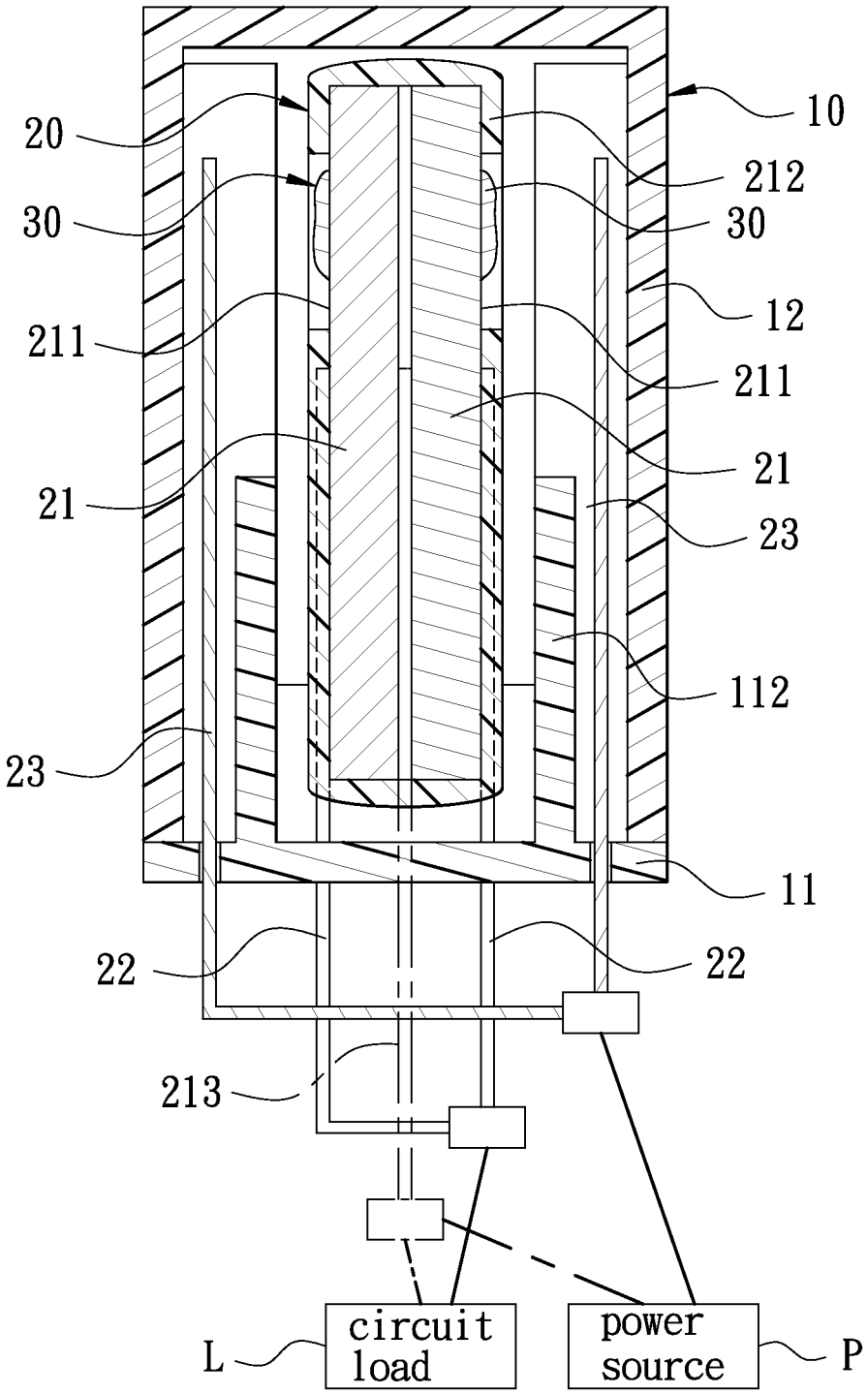
FIG. 8 is a cross-sectional view of the second embodiment of the explosion-proof and flameproof ejection type safety surge-absorbing module showing the resilient metallic plates being ejected from the corresponding electrodes.

Refer to FIGS. 7 and 8, which show the circuit connection with Power Source P and Circuit Load L of the second embodiment of the explosion-proof and flameproof ejection type safety surge-absorbing module. The Power Source P is connected in parallel with the resilient metallic plates 23 and the common lead 213. The Circuit Load L is connected to the electric leads 22 and the common lead 213. It is readily known, with this embodiment of surge-absorbing module, when heat is generated due to surge on the bodies 21 and the temperature exceeds the melting point of the contact component 30, the resilient metallic plates 23 will be ejected due to its resilience and cause an open circuit.

Although particular embodiments of the present invention have been described in detail for purposes of illustration, various modifications and enhancements may be made without departing from the spirit and scope of the appended Claims in accordance with the present invention.

What is claimed is:

1. An explosion-proof and flameproof ejection type safety surge-absorbing module, connecting to a power supply and a circuit load, comprising:

a protective member which comprises a base and an upper lid coupled with said base, said base having two corresponding partitions with identical shape formed thereon and extending upwardly to form a chamber, said base further comprises a plurality of notches at a circumferential portion thereof and said upper lid having a plurality of tenons fitting with said notches for said upper lid to be coupled to said base of the protective member; and a surge-absorbing unit having a body, at least two electric leads and a resilient metallic plate, said body being installed in said chamber of said protective member, said at least two electric leads being connected to at least two electrodes on said body; a first end of said resilient metallic plate connecting to one of said electrodes through a connect component having a substantially low melting point and a second end of said resilient metallic plate penetrating out of said base of said protective member, wherein each of said partitions is formed with a recess at a middle portion thereof, and the first end of the resilient metallic plate crosses the recess and is welded to a surface of one of the electrodes, and an edge of one of the partitions abuts against an inner side of the resilient metallic plate; and wherein said resilient metallic plate and one of the electric leads are connected to said power supply, and said at least two electric leads are connected to said circuit load.

2. An explosion-proof and flameproof ejection type safety surge-absorbing module according to claim 1, wherein said body of said surge-absorbing unit is wrapped with epoxy resin and upper portions of said conducting leads are wrapped in the epoxy resin.

3. An explosion-proof and flameproof ejection type safety surge-absorbing according to claim 1 wherein said connect component is disposed in said recess and said first end of said resilient metallic plate is connected to said connect component in said recess.

4. An explosion-proof and flameproof ejection type safety surge-absorbing according to claim 1, wherein said surge absorbing unit comprises two bodies, two connecting leads and two resilient metallic plates; said two bodies are stacked with a common lead formed between said two bodies; said two contacting leads are connected to said electrodes on said two bodies and said two resilient plates with their respective one first end connected to said electrodes.

5. An explosion-proof and flameproof ejection type safety surge-absorbing module according to claim 1 wherein said contact component is a solder.

* * * * *